US012122567B2

(12) United States Patent
Padilla

(10) Patent No.: US 12,122,567 B2
(45) Date of Patent: Oct. 22, 2024

(54) CARTON AND CARTON BLANK THEREFOR

(71) Applicant: WestRock Shared Services, LLC, Atlanta, GA (US)

(72) Inventor: Jesus A. Padilla, Hoschton, GA (US)

(73) Assignee: WestRock Shared Services, LLC, Atlanta, GA (US)

( * ) Notice: Subject to any disclaimer, the term of this patent is extended or adjusted under 35 U.S.C. 154(b) by 0 days.

(21) Appl. No.: 17/636,747

(22) PCT Filed: Aug. 17, 2020

(86) PCT No.: PCT/US2020/046706
§ 371 (c)(1),
(2) Date: Feb. 18, 2022

(87) PCT Pub. No.: WO2021/034778
PCT Pub. Date: Feb. 25, 2021

(65) Prior Publication Data

US 2022/0297879 A1 Sep. 22, 2022

Related U.S. Application Data

(60) Provisional application No. 62/889,087, filed on Aug. 20, 2019.

(51) Int. Cl.
*B65D 5/72* (2006.01)

(52) U.S. Cl.
CPC ..... *B65D 5/723* (2013.01)

(58) Field of Classification Search
CPC ..... B65D 5/646; B65D 5/723
USPC .... 229/122, 210, 220, 125.12, 131.1, 129.1; 221/302, 305
See application file for complete search history.

(56) References Cited

U.S. PATENT DOCUMENTS 2,342,081 A * 2/1944 Kirkland ..... B65D 5/723 222/565
2,349,748 A * 5/1944 Otto ..... B65D 5/723 222/565
2,903,175 A * 9/1959 Peimer ..... B65D 5/723 229/220
3,040,953 A * 6/1962 Tindall ..... B65D 5/723 229/220

(Continued)

FOREIGN PATENT DOCUMENTS

WO WO-2021005054 A1 * 1/2021 ..... A61B 50/36

*Primary Examiner* — Nathan J Newhouse
*Assistant Examiner* — Phillip D Schmidt
(74) *Attorney, Agent, or Firm* — Neil G. Cohen; Rohini K. Garg

(57) ABSTRACT

Aspects of the disclosure relate to a carton and to a blank for forming the carton. The carton comprises a plurality of walls defining an interior for receiving the one or more articles. One of the plurality of walls includes an inner wall panel and an outer wall panel spaced apart from the inner wall panel to define a void therebetween. The carton comprises a dispenser having an inner dispensing opening provided in the inner wall panel and an outer dispensing opening provided in the outer wall panel and at least partially in registry with the inner dispensing opening to provide a dispenser opening for access to the interior of the carton. The dispenser comprises a slide panel disposed in the void between the inner wall panel and the outer wall panel.

18 Claims, 8 Drawing Sheets

(56) References Cited

U.S. PATENT DOCUMENTS

| | | | | |
|---|---|---|---|---|
| 4,197,985 | A * | 4/1980 | Austin | B65D 5/723<br>222/456 |
| 7,478,744 | B2 * | 1/2009 | Maffei | B65D 5/4229<br>229/220 |
| 9,505,520 | B2 * | 11/2016 | Baker | B65D 5/723 |
| 2003/0226879 | A1 * | 12/2003 | Auclair | B65D 5/721<br>229/122 |

* cited by examiner

CARTON AND CARTON BLANK THEREFOR

TECHNICAL FIELD

The present invention relates to a carton and to a blank for constructing a carton, more specifically to a carton comprising a sliding dispenser to provide access to carton contents.

BACKGROUND

In the field of packaging it is known to provide cartons for holding a variety of items, such as but not limited to food (including fast food/convenience food, confectionary as examples), medical items, cosmetics and other household consumables. Cartons are well known in the art and are useful for enabling consumers to transport and access a plurality of items for use or consumption. For cost and environmental considerations, such cartons or carriers need to be formed from as little material as possible and cause as little wastage in the materials from which they are formed as possible. Further considerations are the strength of the carton and its suitability for holding, supporting, protecting and transporting the items. It is desirable that the contents of the carton are securely retained within the carton during shipping and transportation throughout the journey from filling-plant to storage to point of sale to a customer's home.

Additionally, it is desirable to provide a carton with a dispenser for gaining access to the contents of the carton. In applications where contained items are not used all at once, it can be beneficial for such dispensers to be recloseable for maintaining the unused items securely within the carton; and, in some applications for preserving product freshness.

The present invention seeks to provide an improvement in the field of cartons, typically formed from paperboard or the like and foldable from a flat blank.

SUMMARY

A first aspect of the present disclosure provides a carton for packaging one or more articles. The carton comprises a plurality of walls defining an interior for receiving the one or more articles. One of the plurality of walls includes an inner wall panel and an outer wall panel spaced apart from the inner wall panel to define a void therebetween. The carton comprises a dispenser having an inner dispensing opening provided in the inner wall panel; and an outer dispensing opening provided in the outer wall panel and at least partially in registry with the inner dispensing opening to provide a dispenser opening for access to the interior of the carton. The dispenser comprises a slide panel disposed in the void between the inner wall panel and the outer wall panel. The slide panel is moveable between a first position in which the slide panel closes the dispenser opening and a second position in which the slide panel is retracted to open the dispenser.

In this way a carton of the type formed from folding a sheet of suitable substrate is provided with a sliding dispenser. The sliding dispenser is recloseable, unlike some known tear-out window and open-topped dispensers. A further beneficial feature is that in many applications the retractable, recloseable and sliding dispenser disclosed does not necessarily occupy additional space within the carton structure.

Optionally, the slide panel is severably connected to the inner wall panel by a severable connection. The severable connection may comprise a tear strip. Beneficially, the integrity and security of the carton is maintained until a user purposefully breaks the severable connection for actuating the slide panel dispensing feature.

Optionally, the slide panel comprises a tear strip initiation aperture defining an end of the tear strip.

Optionally, the slide panel comprises at least one handle, hingedly connected thereto.

The slide panel may comprise a first handle tab. The slide panel may comprise a second handle tab.

Optionally, the outer wall panel comprises a guide. The guide may comprise a slot provided by a portion of the outer dispensing opening.

Optionally, the dispenser comprises a follower receivable in the guide.

Optionally, the follower is provided by a handle tab hingedly connected to the slide panel.

Optionally, the outer wall panel comprises a gate panel severably connected thereto and defining, at least in part, the outer dispensing opening. The gate panel may be secured to the slide panel.

Optionally, the gate panel comprises at least one second handle tab, the at least one second handle tab may be secured to at least one first handle tab hingedly connected to the slide panel.

Optionally, the gate panel hingedly connected thereto comprises a first outer handle tab and a second outer handle tab, the first outer handle tab being secured to a first inner handle tab hingedly connected to the slide panel, and the second outer handle tab being secured to a second inner handle tab hingedly connected to the slide panel.

Optionally, the first handle tab is severably connected to a tear tab, the tear tab being provided by the outer wall panel and being severably connected to a bottom panel of the carton.

Optionally, the outer wall panel comprises a tear tab severably connected to the outer wall panel and disposed in an overlying relationship with the tear strip.

A second aspect of the present disclosure provides a blank for forming a carton. The blank comprises a plurality of panels for forming walls of a carton. The plurality of panels includes an inner wall panel; an outer wall panel; the blank comprises features for forming a dispenser including an inner dispensing opening provided in the inner wall panel; an outer dispensing opening provided in the outer wall panel and at least partially in registry with the inner dispensing opening, to provide a dispenser opening for access to the interior of the carton and a slide panel arranged to be disposed between the inner wall panel and the outer wall panel in a setup carton, wherein the slide panel is moveable between a first position in which the slide panel closes the dispenser opening and a second position in which the slide panel is retracted to open the dispenser.

Within the scope of this application it is envisaged or intended that the various aspects, embodiments, examples, features and alternatives set out in the preceding paragraphs, in the claims and/or in the following description and drawings may be considered or taken independently or in any combination thereof.

Features or elements described in connection with, or relation to, one embodiment are applicable to all embodiments unless there is an incompatibility of features. One or more features or elements from one embodiment may be incorporated into, or combined with, any of the other embodiments disclosed herein, said features or elements extracted from said one embodiment may be included in addition to, or in replacement of one or more features or elements of said other embodiment.

A feature, or combination of features, of an embodiment disclosed herein may be extracted in isolation from other features of that embodiment. Alternatively, a feature, or combination of features, of an embodiment may be omitted from that embodiment.

BRIEF DESCRIPTION OF THE DRAWINGS

Embodiments of the invention will now be described with reference to the accompanying drawings, in which.

DETAILED DESCRIPTION OF EMBODIMENTS

Detailed descriptions of specific embodiments of the carriers, blanks and method of construction are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the carriers, blanks and method of construction described herein may be embodied in various and alternative forms. The Figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 1A:
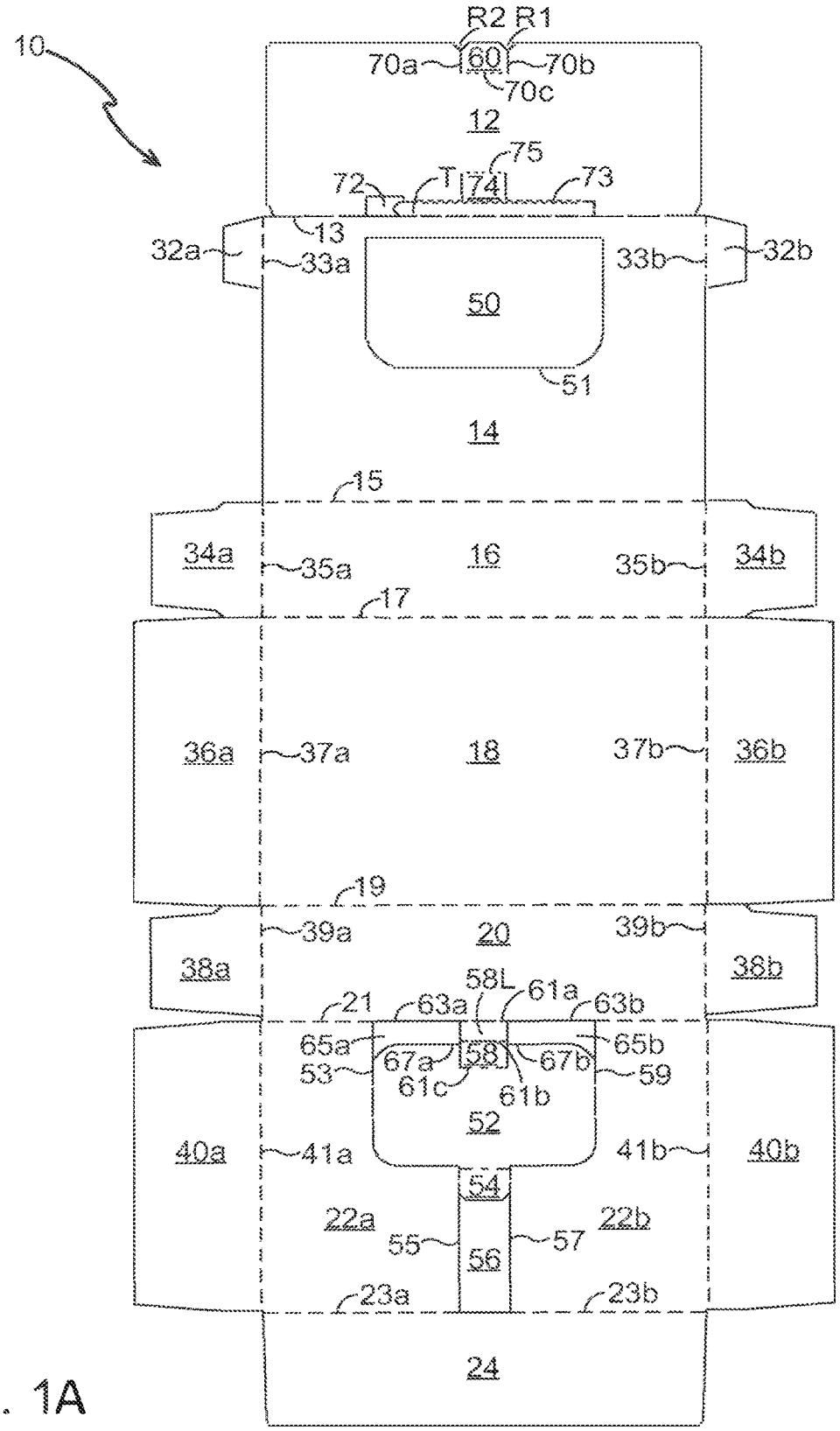
FIG. 1A is a plan view from above of a blank for forming a carrier according to an embodiment of the disclosure.
Figure 1B:
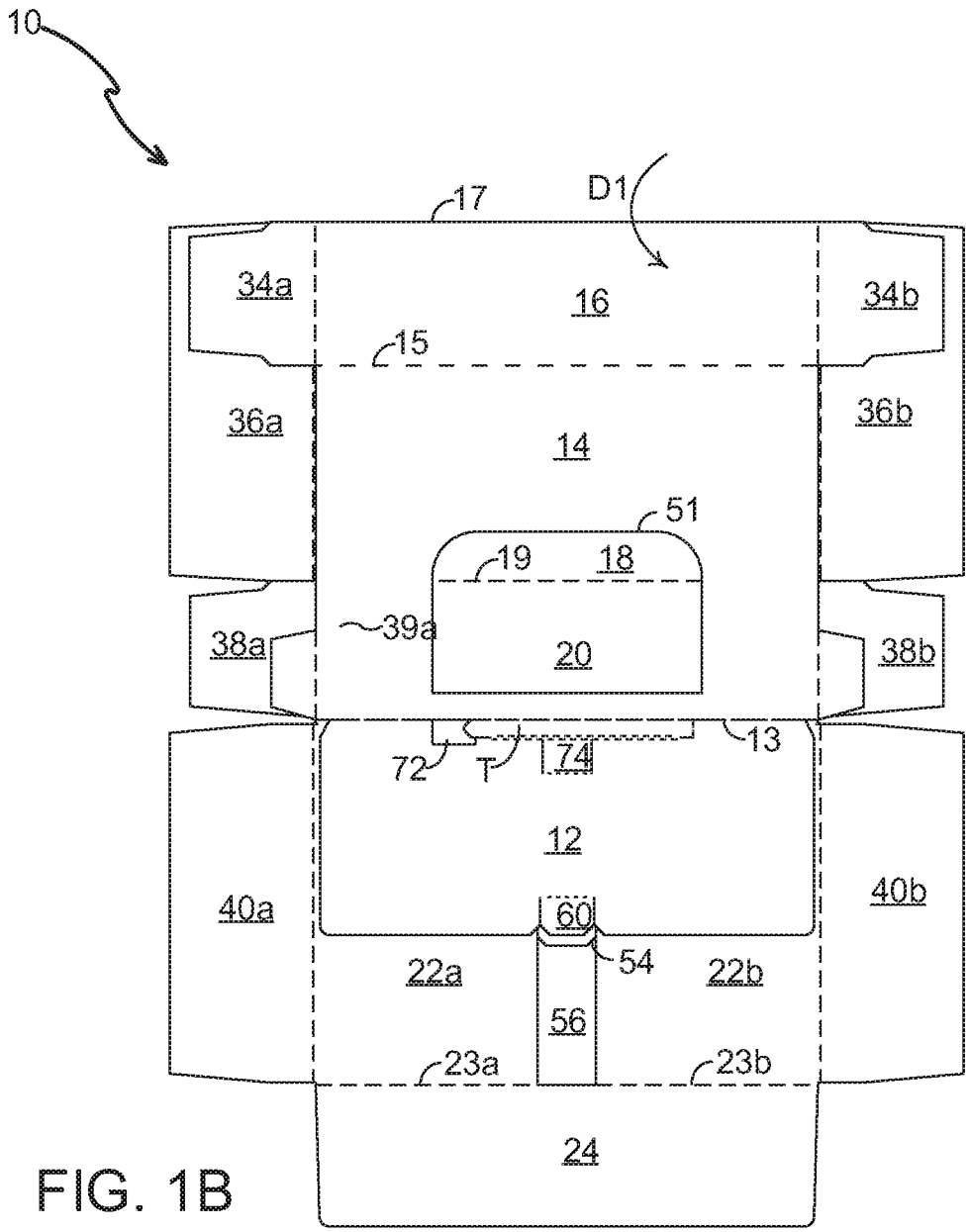
FIGS. 1B to 1D illustrate stages of construction of the blank of FIG. 1A into a carrier.
Figure 1C:
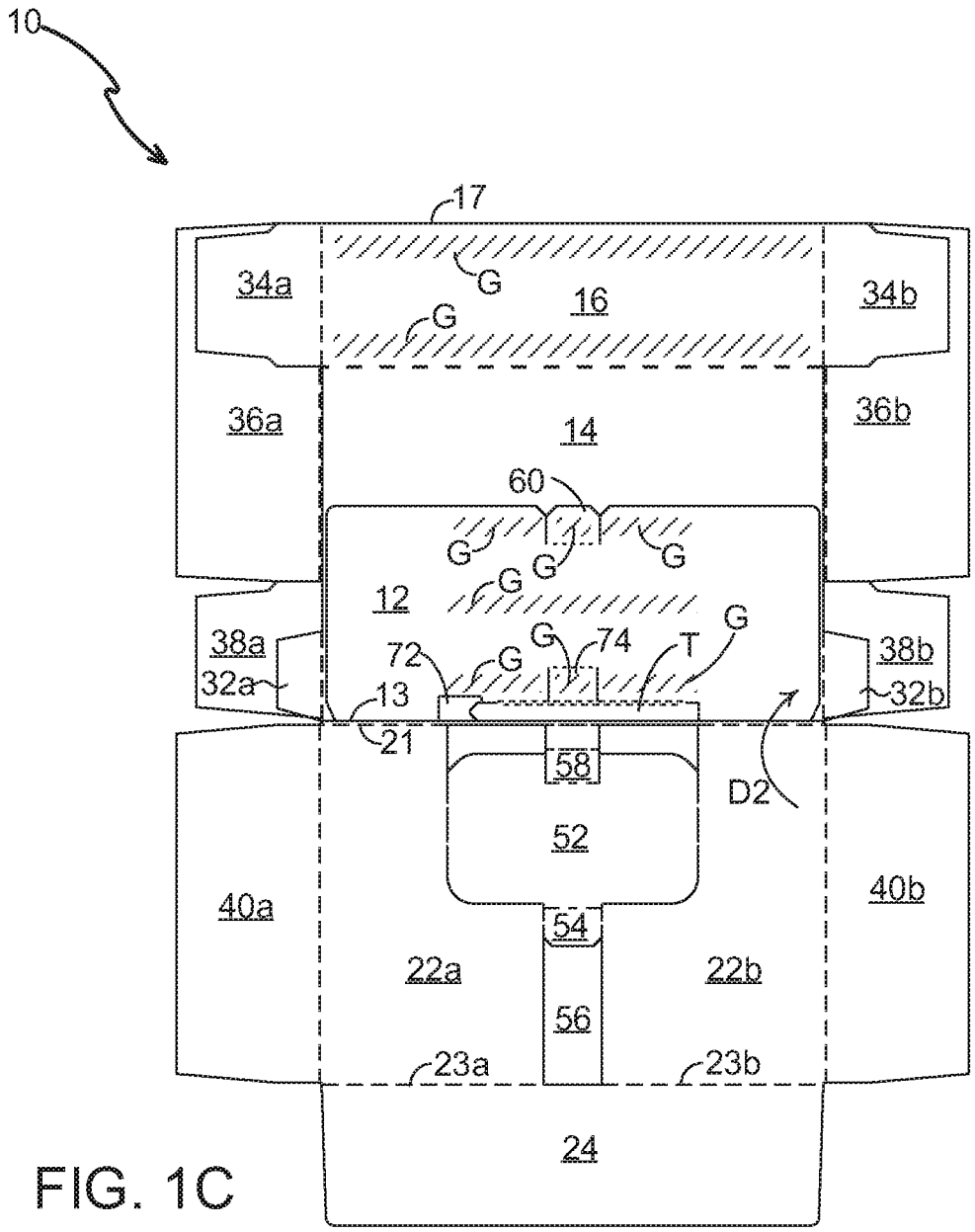
Figure 1D:
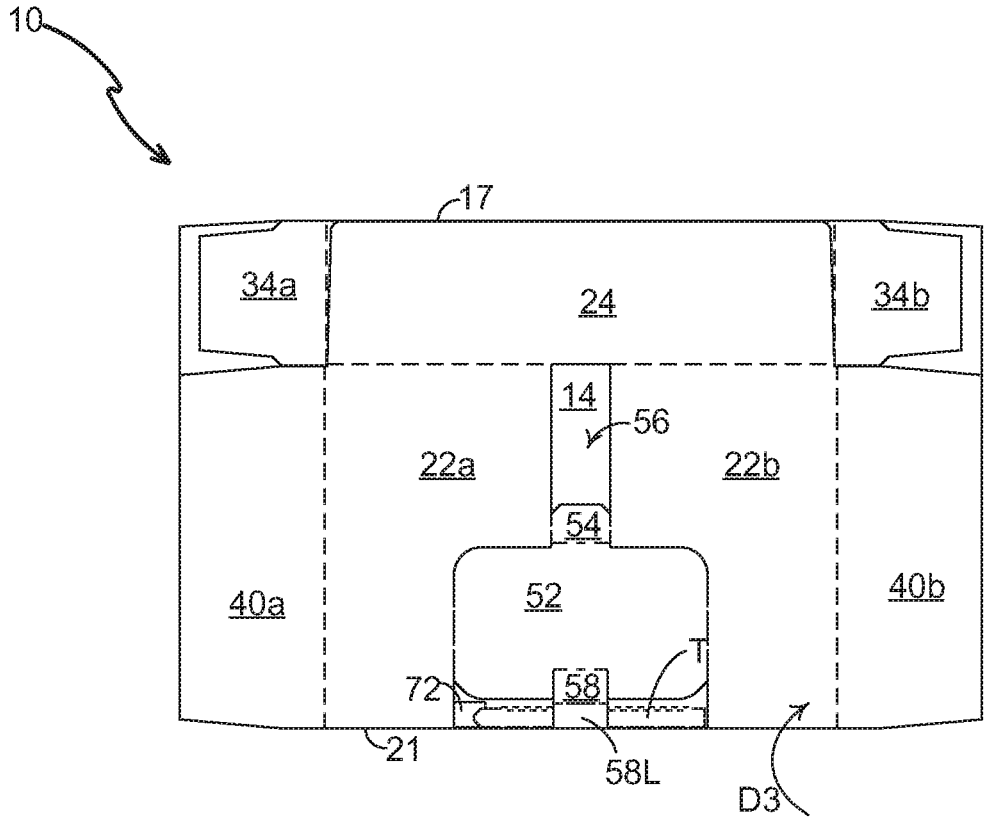
Figure 2:
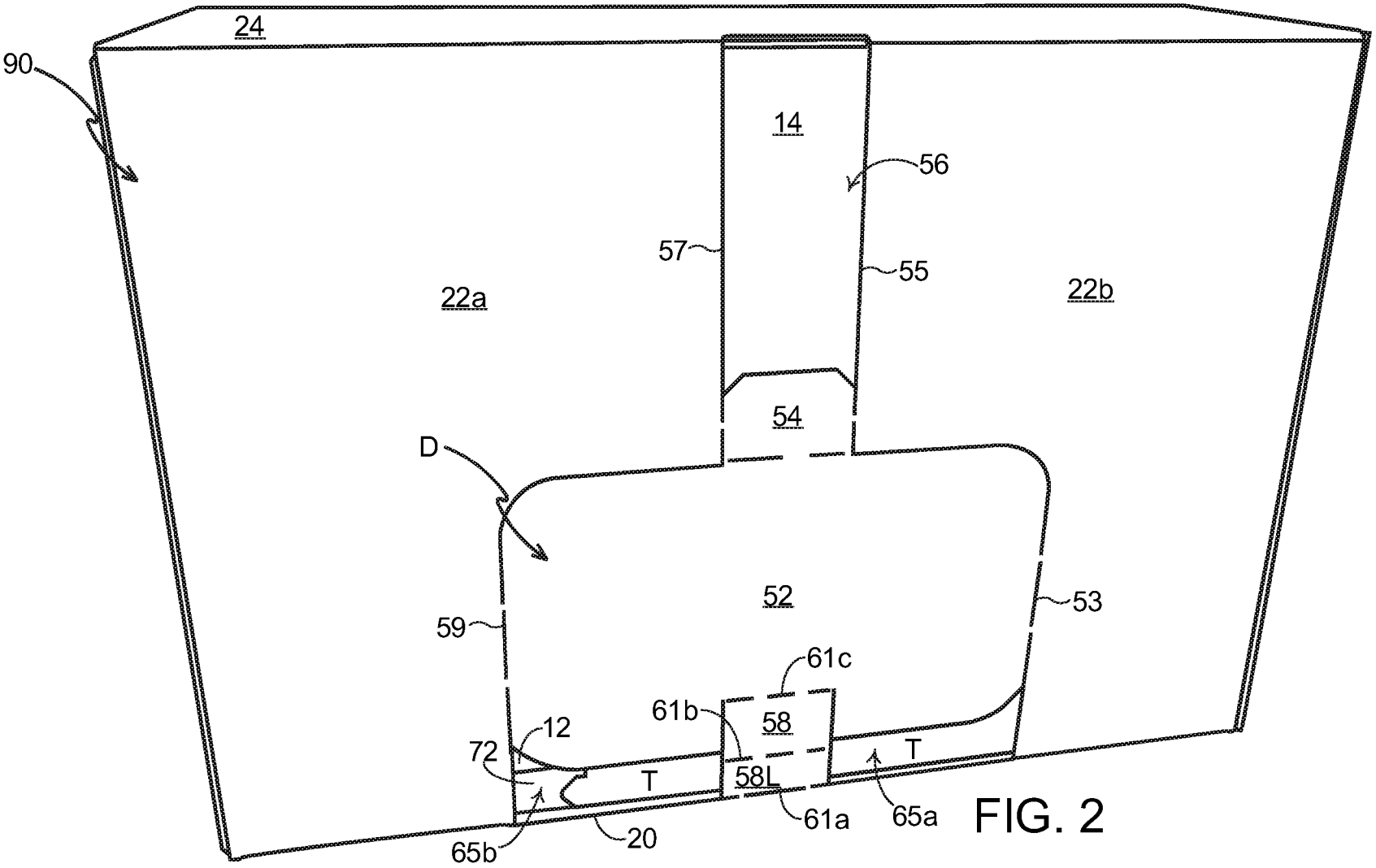
FIG. 2 is a perspective view from above of a carrier formed from the blank of FIG. 1.

Referring to FIG. 1, there is shown a plan view of a blank 10 capable of forming a carton 90, as shown in FIG. 2, for holding an article or product. Carton 90 may have a wide and varied number of applications and may be used for containing and dispensing a wide variety of articles that may be a mix of items, type, variety, flavour, and/or which may all be the same. Examples of the articles that may be combined include food items, for example confectionary and snacks, medical items, cosmetics and household consumables and so on. The carton 90 may be a primary or a secondary package.

In the embodiments detailed herein, the terms "carton" and "carrier" refer, for the non-limiting purpose of illustrating the various features of the invention, to a container for holding and carrying a product. It is contemplated that the teachings of the invention can be applied to various products.

The blank 10 is formed from a sheet of suitable substrate. It is to be understood that, as used herein, the term "suitable substrate" includes all manner of foldable sheet material such as paperboard, corrugated board, cardboard, plastic, combinations thereof, and the like. It should be recognised that one or other numbers of blanks may be employed, where suitable, for example, to provide the carrier structure described in more detail below.

The packaging structures or cartons described herein may be formed from a sheet material such as paperboard, which may be made of, or coated with, materials in order to provide a desired characteristic. For example, but without limitation to, such characteristics may include improved printability strength, tear resistance or moisture resistance. Examples of such sheet material are PrintKote® Poly paperboard and CustomKote™ Poly paperboard made by WestRock Company. It should be noted that the resistant materials may be provided by more than one layer, to help improve the moisture or tear resistance of the package. Typically, one surface of the sheet material may have different characteristics to the other surface. For example, the surface of the sheet material that faces outwardly from a finished package may be particularly smooth and may have a coating such as a clay coating or other surface treatment to provide good printability. The surface of the sheet material that faces inwardly may, on the other hand, be provided with a coating, a layer, a treatment or be otherwise prepared to provide properties such as one or more of moisture resistance, tear-resistance, good glue-ability, heat sealability, or other desired functional properties.

The blank 10 may include a paperboard substrate and may also include a moisture or tear resistant layer laminated together. It optionally includes an adhesive layer between the paperboard substrate and the tear resistant layer. The material of the paperboard substrate may be selected from any conventional paperboard, for example, ranging in weight upwardly from about 10 pt., preferably from about 11 pt. to about 14 pt. An example of such a substrate is a 14-point SBS board or CNK board manufactured by WestRock Company. The paperboard substrate may be a bleached or unbleached board. The board may be coated on at least one side, optionally the side opposite the lamination, with a conventional coating selected for compatibility with the printing method and board composition.

The moisture resistant layer may be disposed over the uncoated side of the paperboard substrate and may be formed of polymeric material and secured to the substrate. The moisture resistant layer imparts toughness to the laminate structure. The moisture resistant layer may be a layer of linear low-density polyethylene (LLDPE). In embodiments where linear low-density polyethylene (LLDPE) or mPE is used, it is not necessary to incorporate an adhesive layer. Other suitable materials having a high level of tear or moisture resistance may also be used.

The adhesive layer may be formed of polyolefin material such as a low-density polyethylene (LDPE). The adhesive layer may be placed between the substrate and the tear/moisture resistant layer to secure the tear/moisture resistant layer to the substrate.

Suitable tear/moisture resistant materials may include, without limitation, tear resistant laminated sheet material, e.g., NATRALOCK® paperboard made by WestRock Company, which may include a layer of an n-axially oriented film, e.g. MYLAR®, which is a bi-axially oriented polyester, oriented nylon, cross-laminated polyolefin or high density polyolefin. The orientation and cross-laminated structure of these materials contribute to the tear resistant characteristic. Also, tear resistance may be attributed to the chemical nature of the tear resistant material such as extruded metallocene-catalyzed polyethylene (mPE).

Referring to FIG. 1, the blank 10 comprises a plurality of main panels 24, 22*a*/22*b*, 20, 18, 16, 14, 12 hinged one to the next in a linear series. The plurality of main panels includes: a first or outer top panel 24; a first outer side panel 22*a*/22*b*;

a bottom panel 20; a second side panel 18; a second or inner top panel 16; a first inner side panel 14 and a slide panel 12.

The slide panel 12 is hingedly connected to the first inner side panel 14 by a hinged connection in the form of a foldable severance line 13. The first inner side panel 14 is hingedly connected to the inner top panel 16 by a hinged connection in the form of a fold line 15. The inner top panel 16 is hingedly connected to the second side panel 18 by a hinged connection in the form of a fold line 17. The second side panel 18 is hingedly connected to the bottom panel 20 by a hinged connection in the form of a fold line 19. The bottom panel 20 is hingedly connected to the first outer side panel 22*a*/22*b* by a hinged connection in the form of a fold line 21. The first outer side panel 22*a*/22*b* is hingedly connected to the outer top panel 24 by a hinged connection in the form of a fold lines 23*a*, 23*b*. Fold lines 23*a*, 23*b* are collinear with each other and spaced apart or interrupted by a first aperture 56.

The inner top panel 16 and the outer top panel 24 form a composite top wall 16/24 of the carton 90. The first inner side panel 14 and the first outer side panel 22*a*/22*b* form a side wall 14/22*a*/22*b* of the carton 90. The side wall 14/22*a*/22*b* takes the form of a cavity wall—two 'skins' separated by a void. The slide panel 12 is disposed in the void.

The blank 10 comprises end closure structures for closing each end of a tubular structure or sleeve defined by the plurality of main panels 24, 22*a*/22*b*, 20, 18, 16, 14, 12.

A first end closure structure 34*a*/36*a*/38*a*/40*a* at least partially closes a first end of the tubular structure. The first end closure structure 34*a*/36*a*/38*a*/40*a* comprises a plurality of end closure flaps 34*a*, 36*a*, 38*a*, 40*a* hinged along a first end of the blank 10. A first end closure flap 34*a* is hingedly connected to the inner top panel 16 by a hinged connection in the form of a fold line 35*a*. A second end closure flap 36*a* is hingedly connected to the second side panel 18 by a hinged connection in the form of a fold line 37*a*. A third end closure flap 38*a* is hingedly connected to the bottom panel 20 by a hinged connection in the form of a fold line 39*a*. A fourth end closure flap 40*a* is hingedly connected to the first outer side panel 22*a*/22*b* by a hinged connection in the form of a fold line 41*a*.

A second end closure structure 34*b*/36*b*/38*b*/40*b* at least partially closes a second end of the tubular structure. The second end closure structure 34*b*/36*b*/38*b*/40*b* comprises a plurality of end closure flaps 34*b*, 36*b*, 38*b*, 40*b* hinged along a second end of the blank 10. A fifth end closure flap 34*b* is hingedly connected to the inner top panel 16 by a hinged connection in the form of a fold line 35*b*. A sixth end closure flap 36*b* is hingedly connected to the second side panel 18 by a hinged connection in the form of a fold line 37*b*. A seventh end closure flap 38*b* is hingedly connected to the bottom panel 20 by a hinged connection in the form of a fold line 39*b*. An eighth end closure flap 40*b* is hingedly connected to the first outer side panel 22*a*/22*b* by a hinged connection in the form of a fold line 41*b*.

The second, fourth, sixth and eighth end closure flaps 36*a*, 40*a*, 36*b*, 40*b* form major end closure flaps. The first, third, fifth and seventh end closure flaps 34*a*, 38*a*, 34*b*, 38*b* form minor end closure flaps or "dust flaps".

The first inner side panel 14 comprises a pair of flaps 32*a*, 32*b* hingedly connected to opposed ends of thereof by respective fold lines 33*a*, 33*b*.

The blank 10 comprises a dispenser structure. The dispenser structure comprises an opening in the first side wall 14/22*a*/22*b* of the carton 90 and a slideable closure.

The first inner side panel 14 comprises a cutaway 51 in the form of an aperture 50 which defines an inner dispensing opening 50. The cutaway 51 may be spaced apart form a lower edge of the first inner side panel 14 (defined by foldable severance line 13); so as to define a sill or threshold 14S (see FIG. 5) along the bottom of the inner dispensing opening 50.

The first outer side panel 22*a*/22*b* comprises an outer dispenser opening. The outer dispenser opening may extend across the first outer side panel 22*a*/22*b* from a first, lower-edge 63*a*/63*b* to a second upper-edge. The first lower-edge 63*a*/63*b* is defined by a hinged connection to the bottom panel 20; and the second upper-edge is defined by a hinged connection to the outer top panel 24.

The outer dispenser opening may be defined in part by a door or gate panel 52 struck from or defined in the first outer side panel 22*a*/22*b*. The gate panel 52 is defined in part by cut lines 67*a*, 67*b*; and in part by weakened lines of severance 53, 59. Upper and lower edges of the gate panel 52 may be defined by cutlines. Opposed side edges of the gate panel 52 may be defined by the weakened lines of severance 53, 59. The gate panel 52 is severable or detachable from the first outer side panel 22*a*/22*b*.

The outer dispenser opening is defined in part by a slot 65*a*/65*b*, which may also be considered as or pair of apertures 65*a*, 65*b*. The slot 65*a*/65*b* is interrupted by a tear tab 58L. The tear tab 58L spaces apart the pair of apertures 65*a*, 65*b*. The tear tab 58L is frangibly connected to the bottom panel 20 by a first severable connection in the form of a weakened line of severance 61*a*.

Respective lower edges 63*a*, 63*b* of the pair of apertures 65*a*, 65*b* may be collinearly arranged with the fold line 21 which hinges the bottom panel 20 to the first outer side panel 22*a*/22*b*.

The dispenser structure further comprises a first lower-handle tab 58. The first lower-handle tab 58 is hingedly connected to a lower edge of the gate panel 52 by a hinged connection in the form of a fold line 61*c*. At least a part of the first lower-handle tab 58 may be struck from, or defined within, the gate panel 52. The first lower-handle tab 58 is frangibly connected to the tear tab 58L by a second severable connection in the form of a second weakened line of severance 61*b*.

Optionally, the dispenser structure comprises a receiver or guide slot, the guide slot is provided by an upper part 56 of the dispenser opening. The upper part 56 of the dispenser opening extends from the gate panel 52 to the outer top panel 24, and may interrupt the fold line 23*a*/23*b* which hinges the outer top panel 24 to the first outer side panel 22*a*/22*b*. The upper part 56 of the dispenser opening comprises opposed side edges 55, 57. A first of the opposed side edges 55 defines in part a free edge of a first part 22*a* of the first outer side panel 22*a*/22*b*. A second of the opposed side edges 57 defines in part a free edge of a second part 22*b* of the first outer side panel 22*a*/22*b*.

The dispenser structure may also comprise a second upper-handle tab 54. The second upper-handle tab 54 is hingedly connected to an upper edge of the gate panel 52 by a hinged connection in the form of a fold line (denoted by a dashed line in FIG. 1). In some embodiments, at least part of the second upper-handle tab 54 may be struck from or defined in the gate panel 52. The second upper-handle tab 54 may be frangibly connected to the first outer side panel 22*a*/22*b* along opposed side edges thereof. The second upper-handle tab 54 may define a part of the guide slot. The second, upper handle tab 54 may be dimensioned and arranged so as to form a follower within the guide slot. Similarly, the first lower-handle tab 58 may be dimensioned and arranged to be received within the guide slot.

The dispenser structure also comprises an inner gate provided in part by the slide panel 12. The slide panel 12 comprises a tear strip T along a lower edge thereof. The tear strip T is defined by a tear line 73 and by the foldable severance line 13. The tear line 73 defines an upper edge of the tear strip T. The foldable severance line 13 defines a lower edge of the tear strip T.

A first end of the tear strip T is defined by a cutaway in the form of a tear initiation aperture 72. The opposing end of the tear strip T is defined by a weakened line of severance.

The tear strip T and tear initiation aperture 72 are dimensioned such that they have a depth or height that is less than or equal to the depth or height of the upstanding region of the first inner side panel 14 which provides the sill below the cutaway 51.

The slide panel 12 comprises third handle tab 74. The third handle tab 74 is arranged to be in registry with the first handle tab 58. The third handle tab 74 is hingedly connected to the slide panel 12 by a hinged connection in the form of a fold line 75. The third handle tab 74 is struck from, or defined in, the slide panel 12. The third handle tab 74 is frangibly connected to the tear strip T by the tear line 73.

The slide panel 12 comprises a fourth handle tab 60. The fourth handle tab 60 is arranged to be in registry with the second handle tab 54. The fourth handle tab 60 is hingedly connected to the slide panel 12 by a hinged connection in the form of a fold line 70*c*. The third handle tab 74 is struck from, or defined in, the slide panel 12 and is defined in part by a pair of opposed cutlines 70*a*, 70*b* which extend inwardly from a free, upper, edge of the slide panel 12.

The slide panel 12 is dimensioned such that it is large enough to obscure or conceal the cutaway 51 in the assembled carton 90. The slide panel 12 is dimensioned such that it has a width that is greater in dimension than a width of each of the inner and outer dispenser openings 50/51, 52/56.

The slide panel 12 may be arranged such that its opposed side edges are marginally inset with respect to the respective side edges of the first inner and first outer side panels 14, 22*a*/22*b*. In this way the fourth and eight end closure panels 40*a*, 40*b*, which close opposed end of the void between the first inner and first outer side panels 14, 22*a*/22*b*, act as guides or runners for controlling sliding of the slide panel 12.

Turning to the construction of the carrier 90 as illustrated in FIGS. 1B to 2, the carrier 90 can be formed by a series of sequential folding operations in a straight-line machine so that the carrier 90 is not required to be rotated or inverted to complete its construction. The folding process is not limited to that described below and may be altered according to particular manufacturing requirements.

The blank 10 is folded about fold line 17, such that the inner top panel 16 is folded with respect to the second side panel 18, as indicated by direction arrow D1 shown in FIG. 1B. The inner top panel 16 is thereby brought into face to face relationship with the second side panel 18; the first inner side panel 14 is brought into face to face relationship with the second side panel 18 and the bottom panel 20; and the slide panel 12 is brought into face to face relationship with the first outer side panel 22*a*/22*b*.

The blank 10 is then folded about foldable severance line 13, such that the slide panel 12 is folded with respect to the first inner side panel 14, as indicated by direction arrow D2 shown in FIG. 1C. In this way, an outer surface of the slide panel 12 is brought into face to face relationship with an outer surface of the first inner side panel 14.

Glue or other adhesive treatment is applied to a region of an inner surface of the slide panel 12, which region is arranged to be in registry with the gate panel 52. In other embodiments glue or other adhesive treatment may be applied to a corresponding or appropriate region of the inner surface of the gate panel 52.

Glue or other adhesive treatment G is also applied to an inner surface of the third and fourth handle tabs 60, 74. In other embodiments glue or other adhesive treatment may be applied to corresponding regions of the inner surface of the first and second handle flaps 58, 54.

Glue or other adhesive treatment G is also applied to an outer surface of the inner top panel 16. In other embodiments glue or other adhesive treatment may be applied to corresponding regions of the inner surface of the outer top panel 24.

The blank 10 is folded about fold line 21, such that the first outer side panel 22*a*/22*b* is folded with respect to the bottom panel 20, as indicated by direction arrow D3 shown in FIG. 1D. In this way, the outer top panel 24 is brought into face contacting relationship with, and affixed to, the inner top panel 16; the first outer side panel 22*a*/22*b* is brought into face contacting relationship with the slide panel 12; the gate panel 52 is secured to the slide panel 12; the fourth and eighth end closure panels 40*a*, 40*b* are brought into face contacting relationship with respective ones of the first and second flaps 32*a*, 32*b*.

In this way a flat collapsed tubular structure is formed as shown in FIG. 1D. The inner surface of the slide panel 12 (and third and fourth handle tabs 60, 74) is disposed outermost in the assembled carton 90 due to the "Z" folded arrangement of the blank 10.

The flat collapsed carrier can be readily shipped or distributed in the flat condition to a plant for erecting and loading with primary product containers, articles or various items as described above.

The flat collapsed tubular structure can be opened into an open ended tubular structure or tubular sleeve by unfolding the first inner and outer side panels 14, 22*a*/22*b* with respect to bottom panel 20 such that the first side wall 14/22*a*/22*b* is disposed substantially perpendicularly with respect to the bottom wall 20.

The carton 90, in its open ended tubular form, may be loaded with one or more articles through one or both open ends thereof. It will be appreciated that in some embodiments one of the open ends of the carton 90 may be closed before loading the interior with articles through the remaining open end.

Once the carton 90 has been loaded with articles the open ends of the carton 90 are closed.

The method for closing each of the open ends of the carton 90 is substantially the same and will be described by reference to closing the first open end.

A first end of the tubular structure is closed by folding the first end closure panel 34*a* about fold line 35*a* and by folding the third end closure panel 38*a* about fold line 39*a*.

Glue or other adhesive treatment may be applied to a first portion of an inner surface of the second end closure panel 36*a*. In alternative embodiments glue or other adhesive treatment may be applied to a corresponding portion of an outer surface of first end closure panel 34*a*.

Glue or other adhesive treatment may be applied to a second portion of an inner surface of the second end closure panel 36*a*. In alternative embodiments glue or other adhesive treatment may be applied to a corresponding portion of an outer surface of third end closure panel 38*a*.

The second end closure panel 36*a* is then folded about the fold line 37*a* to be brought into contact with the first and third end closure panels 34*a*, 38*a*. The second end closure panel 36*a* may be secured to each of the first and third end closure panels 34*a*, 38*a*.

Glue or other adhesive treatment is applied to a portion of an inner surface of the fourth end closure panel 40*a*. In alternative embodiments glue or other adhesive treatment may be applied to a portion of an outer surface of the second end closure panel 36*a*.

The fourth end closure panel 40*a* is then folded about the fold line 41*a* (along with the first securing flap 32*a* which is folded about fold line 33*a*). The fourth end closure panel 40*a* is brought into contact with the second end closure panel 36*a* and optionally into contact with the first and third end closure panels 34*a*, 38*a*.

The fourth end closure panel 40*a* is secured to the second end closure panel 36*a*. The fourth end closure panel 40*a* may be secured to the first and third end closure panels 34*a*, 38*a*, for example by glue or other adhesive treatment.

In alternative embodiments the second end closure panel 36*a* may be folded about fold line 37*a* after folding the fourth end closure panel 40*a* about fold line 41*a*. It will be appreciated that in such embodiments the second end closure panel 36*a* is disposed outermost.

In other embodiments alternative securing means may be employed to secure the end closure panels 34*a*, 36*a*, 38*a*, 40*a*, 34*b*, 36*b*, 38*b*, 40*b* for example, but not limited to, mechanical locking devices such as staples or punch locks integrally formed within the end closure panels 34*a*, 36*a*, 38*a*, 40*a*, 34*b*, 36*b*, 38*b*, 40*b*.

The process described above in relation to the first end is replicated to close the second end of the carton 90 and is not further described.

The assembled carton 90 is shown in FIG. 2. The carton 90 comprises a dispenser in the first sidewall. The gate panel 52 is attached to the first outer side panel 22*a*/22*b*. The gate panel 52 provides a printable surface. The gate panel 52 provides an outer surface having similar characteristics to the first outer side panel 22*a*/22*b*. The outer facing surface of the slide panel 12 is an inner surface of the blank 10. In embodiments where only one surface of the substrate material is coated for printability the coated side of the slide panel 12 may therefore be disposed innermost with the uncoated surfacing facing outwardly. The gate panel 52 conceals substantially all of the uncoated (reverse) side of the substrate provided by the slide panel 12.

A portion of the uncoated or reverse side of the substrate may be visible along a lower region of the dispenser and may alert or inform or otherwise visually prompt a consumer to the tear strip T.

Figure 3:
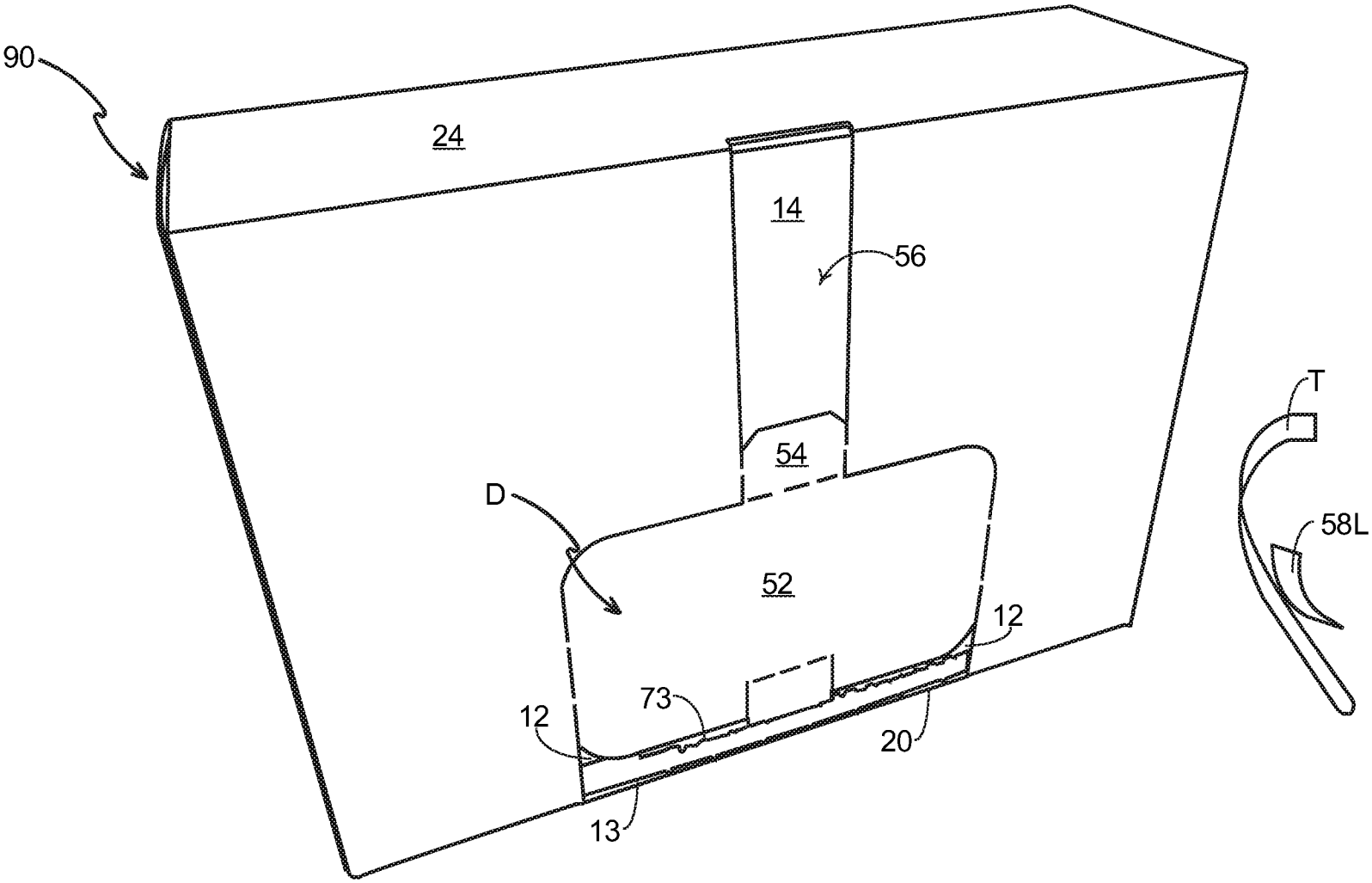
FIGS. 3 to 5 are a perspective views from above of the carrier of FIG. 2 in which a dispenser is in various stages of deployment.

FIG. 3 shows a stage of deployment of the dispenser D, wherein the tear strip T has been detached from the carton 90. In doing so the tear tab 58L has been removed or severed from the first outer side panel 22*a*/22*b*.

Figure 4:
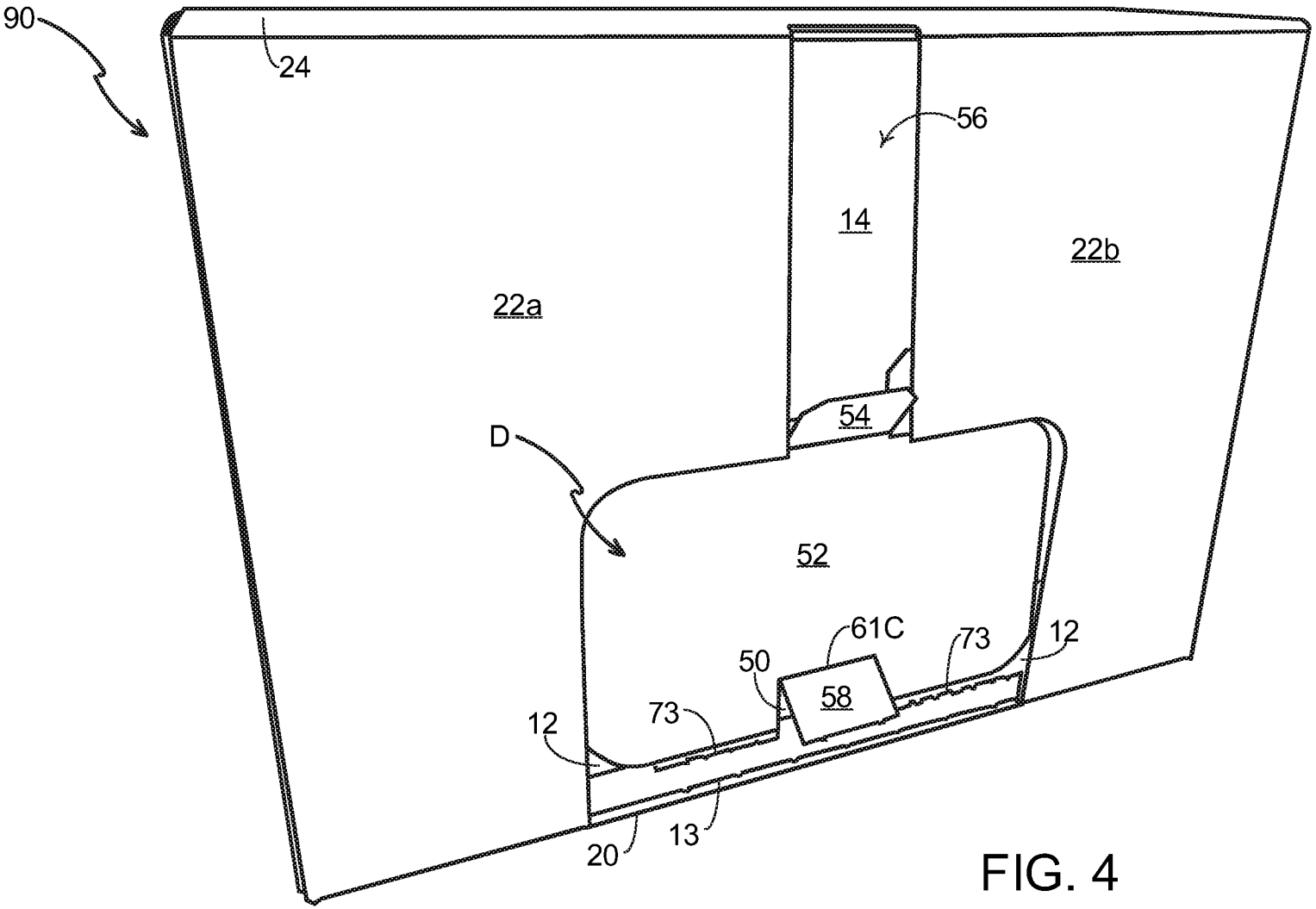

FIG. 4 shows another stage of deployment of the dispenser D, wherein the gate panel 52 has been separated from the first outer side panel 22*a*/22*b*. The first handle tab 58 (along with the third handle tab 74 which is secured to the rear, inner, surface of the first handle tab 58) has been folded outwardly. The second handle tab 54 has been separated from first outer side panel 22*a*/22*b*. The second handle tab 54 (along with the fourth handle tab 60 which is secured to the rear, inner, surface of the second handle tab 54) has also been folded outwardly.

Figure 5:
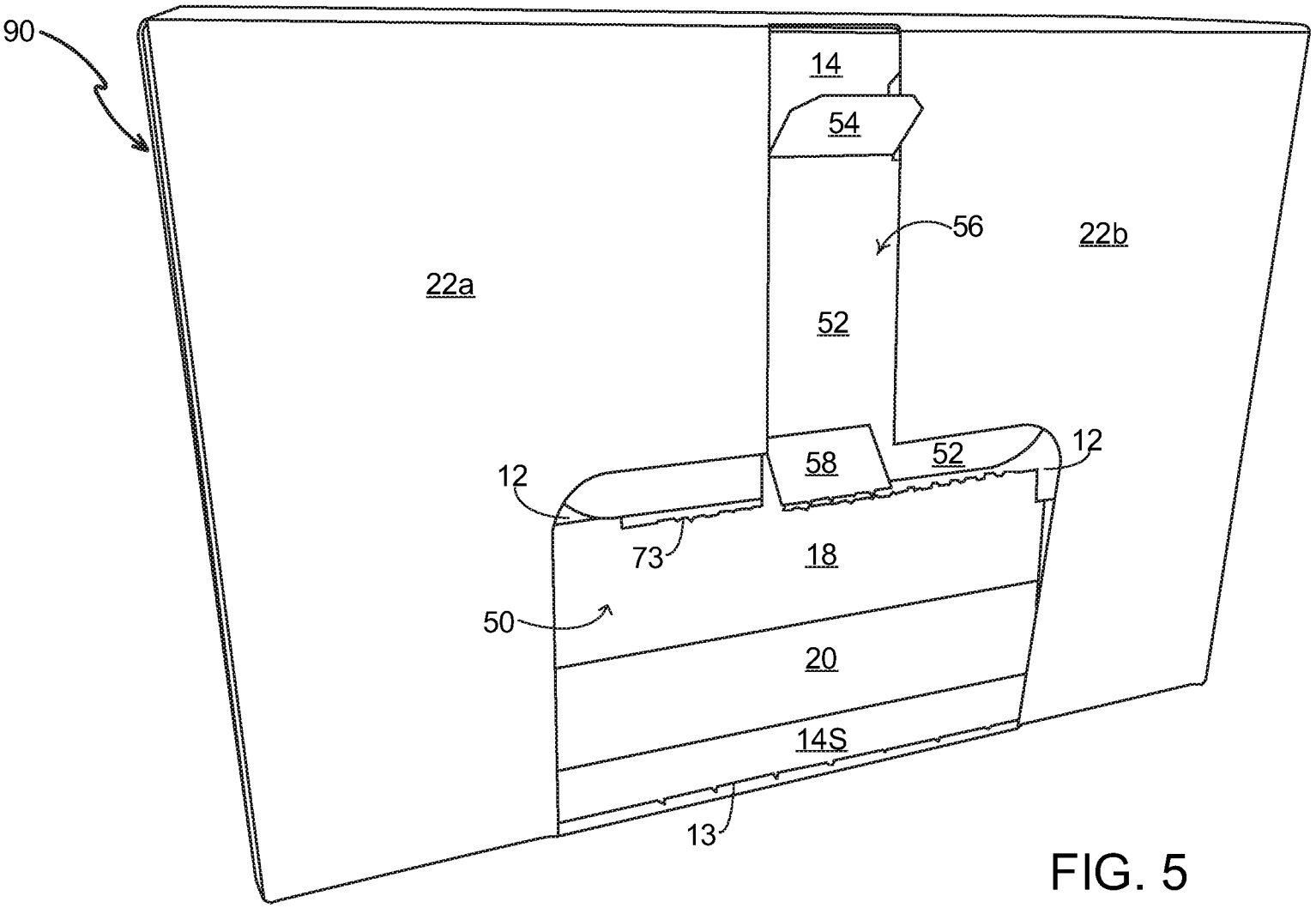

FIG. 5 shows a further stage of deployment of the dispenser D, wherein the gate panel 52 and the slide panel 12 have been moved upwardly by a user. The user may grip one or both of the first and second handle tabs 58, 54 and apply appropriately directed force to translate, slide, manipulate or otherwise move the gate panel 52 and the slide panel 12 towards the composite top wall 16/24 of the carton 90.

The slide panel 12 is slid upwardly between the first inner and first outer side panel 14, 22*a*/22*b*.

As can be seen in FIG. 5, the gate panel 52 has been displaced inwardly of the first outer side panel 22*a*/22*b* and slid behind portions of the first outer side panel 14, 22*a*/22*b*.

The first handle tab 58 along with the third handle tab 74 has been slid up the guide slot 56

An upper edge of the slide panel 12 may contact the composite top wall 16/24 of the carton 90 to provide an end stop which limits the extent of travel of the gate panel 52 and slide panel 12.

When the slide panel 12 and gate panel 54 are moved upwardly, the inner dispensing opening 50 is exposed or revealed. The contents of the carton 90 may be removed through the dispenser opening. In FIG. 5, an empty carton 90 is illustrated, and no articles are shown.

The slide panel 12 and gate panel 52 may be returned to the position shown in FIG. 4 to reclose the carton 90.

It will be recognized upon reading the above description that the carton 90 can alternatively be oriented for other applications as required, such that the carton 90 is laid to rest on its first outer and second inner top panels 24/16. With the carton 90 in this orientation, the slide panel 12 may be slidably moved from a "dispenser-closed" to a "dispenser-open" condition by downwardly sliding, moving, translating, or descending the slide panel 12.

It can be appreciated that various changes may be made within the scope of the present invention. For example, the size and shape of the panels and apertures may be adjusted to accommodate articles of differing size or shape. In one alternative embodiment the plurality of teeth may be replaced with a continuous wall which surrounds the applicator article group, the lower edge of the wall may be castellated or crenellated with one or more recesses to accommodate the peripheral walls of the tray component.

It will be recognised that as used herein, directional references such as "top", "bottom", "base", "front", "back", "end", "side", "inner", "outer", "upper" and "lower" do not necessarily limit the respective panels to such orientation, but may merely serve to distinguish these panels from one another.

As used herein, the terms "hinged connection" and "fold line" refer to all manner of lines that define hinge features of the blank, facilitate folding portions of the blank with respect to one another, or otherwise indicate optimal panel folding locations for the blank. Any reference to "hinged connection" should not be construed as necessarily referring to a single fold line only; indeed a hinged connection can be formed from two or more fold lines wherein each of the two or more fold lines may be either straight/linear or curved/curvilinear in shape. When linear fold lines form a hinged connection, they may be disposed parallel with each other or be slightly angled with respect to each other. When curvilinear fold lines form a hinged connection, they may intersect each other to define a shaped panel within the area surrounded by the curvilinear fold lines. A typical example of such a hinged connection may comprise a pair of arched or arcuate fold lines intersecting at two points such that they define an elliptical panel therebetween. A hinged connection may be formed from one or more linear fold lines and one or more curvilinear fold lines. A typical example of such a hinged connection may comprise a combination of a linear fold line and an arched or arcuate fold line which intersect at two points such that they define a half moon-shaped panel therebetween.

As used herein, the term "fold line" may refer to one of the following: a scored line, an embossed line, a debossed line, a line of perforations, a line of short slits, a line of half-cuts, a single half-cut, an interrupted cutline, a line of aligned slits, a line of scores and any combination of the aforesaid options.

It should be understood that hinged connections and fold lines can each include elements that are formed in the substrate of the blank including perforations, a line of perforations, a line of short slits, a line of half-cuts, a single half-cut, a cutline, an interrupted cutline, slits, scores, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking, to facilitate folding and facilitate breaking with more effort, or to facilitate breaking with little effort.

The phrase "in registry with" as used herein refers to the alignment of two or more elements in an erected carton, such as an aperture formed in a first of two overlapping panels and a second aperture formed in a second of two overlapping panels. Those elements in registry with each other may be aligned with each other in the direction of the thickness of the overlapping panels. For example, when an aperture in a first panel is "in registry with" a second aperture in a second panel that is placed in an overlapping arrangement with the first panel, an edge of the aperture may extend along at least a portion of an edge of the second aperture and may be aligned, in the direction of the thickness of the first and second panels, with the second aperture.

The invention claimed is:

1. A carton for packaging one or more articles, the carton comprising a plurality of walls defining an interior for receiving the one or more articles, one of the plurality of walls including:

an inner wall panel; and an outer wall panel spaced apart from the inner wall panel to define a void therebetween;

the carton comprising a dispenser including:

an inner dispensing opening provided in the inner wall panel;

an outer dispensing opening provided in the outer wall panel, the outer dispensing opening being at least partially in registry with the inner dispensing opening, to provide together with the inner dispensing opening a dispenser feature for providing access to the interior of the carton;

a gate panel defining at least in part the outer dispensing opening; and a slide panel disposed in said void between the inner wall panel and the outer wall panel, wherein the slide panel is moveable between a first position in which the slide panel closes the inner dispenser opening and a second position in which the slide panel is retracted to open the dispenser, and wherein the gate panel is connected to the slide panel so that the gate panel is configured to move with the slide panel between the first position and the second position.

2. A carton according to claim 1 wherein the slide panel is severably connected to the inner wall panel by a severable connection.

3. A carton according to claim 2 wherein the severable connection comprises a tear strip.

4. A carton according to claim 3 wherein the slide panel comprises a tear strip initiation aperture defining an end of the tear strip.

5. A carton according to claim 3 wherein the outer wall panel comprises a tear tab severably connected to the outer wall panel and disposed in an overlying relationship with the tear strip.

6. A carton according to claim 1 wherein the slide panel comprises at least one handle hingedly connected thereto.

7. A carton according to claim 1 wherein the slide panel comprises a first handle tab.

8. A carton according to claim 7 wherein the slide panel comprises a second handle tab.

9. The carton according to claim 7 wherein the first handle tab is severably connected to a tear tab, the tear tab being provided by the outer wall panel and being severably connected to a bottom panel of the carton.

10. A carton according to claim 1 wherein the outer wall panel comprises a guide.

11. A carton according to claim 10 wherein the guide comprises a slot provided by a portion of the outer dispensing opening.

12. A carton according to claim 10 wherein the dispenser comprises a follower receivable in the guide.

13. A carton according to claim 12 wherein the follower is provided by a handle tab hingedly connected to the slide panel.

14. A carton according to claim 1 wherein the outer wall panel comprises the gate panel severably connected thereto.

15. A carton according to claim 1, wherein the gate panel is secured to the slide panel.

16. A carton according to claim 14 wherein the gate panel comprises at least one second handle tab, the at least one second handle tab is secured to at least one first handle tab hingedly connected to the slide panel.

17. A carton according to claim 14 wherein the gate panel comprises a first outer handle tab and a second outer handle tab, the first outer handle tab being secured to a first inner handle tab hingedly connected to the slide panel, and the second outer handle tab being secured to a second inner handle tab hingedly connected to the slide panel.

18. A blank for forming a carton, the blank comprising a plurality of panels for forming walls of a carton, the plurality of panels including:

an inner wall panel;

an outer wall panel;

the blank comprising features for forming a dispenser including:

an inner dispensing opening provided in said inner wall panel;

an outer dispensing opening provided in the outer wall panel and at least partially in registry with the inner dispensing opening, to provide a dispenser opening for access to the interior of the carton;

a gate panel defining at least in part the outer dispensing opening; and a slide panel arranged to be disposed between the inner wall panel and the outer wall panel in a setup carton, wherein the slide panel is moveable between a first position in which the slide panel closes the dispenser opening and a second position in which the slide panel is retracted to open the dispenser, and wherein the gate panel is connected to the slide panel so that the gate panel is configured to move with the slide panel between the first position and the second position.

* * * * *